United States Patent [19]

Archambault

[11] Patent Number: 4,998,550

[45] Date of Patent: Mar. 12, 1991

[54] GASKETLESS DOOR FOR DOMESTIC DISHWASHERS

[76] Inventor: Jean Archambault, 500 Francois St., Apartment 207, Ile des Soeurs, Canada, H3E 1G4

[21] Appl. No.: 498,397

[22] Filed: Mar. 26, 1990

Related U.S. Application Data

[63] Continuation-in-part of Ser. No. 369,243, Jun. 21, 1989, abandoned.

[30] Foreign Application Priority Data

Feb. 8, 1989 [CA] Canada ..... 590677

[51] Int. Cl.[5] ..... A47L 15/42

[52] U.S. Cl. ..... 134/200; 220/366; 220/374; 277/56

[58] Field of Search ..... 220/228, 354, 355, 366, 220/373, 374, 659; 312/296; 277/55, 56, 57; 134/57 D, 200, 57 DL, 58 DL

[56] References Cited

U.S. PATENT DOCUMENTS

| | | | |
|---|---|---|---|
| 1,948,820 | 2/1934 | Lasker | 220/228 |
| 2,108,724 | 2/1938 | Nemetz | 277/57 |
| 3,043,724 | 7/1962 | Balshan | 134/57 D X |
| 3,292,645 | 12/1966 | Braden et al. | 134/57 D |
| 3,295,541 | 1/1967 | Ummel | 134/200 X |
| 3,842,902 | 10/1974 | Poslusny | 277/57 X |
| 4,358,908 | 11/1982 | Song | 220/366 X |

*Primary Examiner*—Philip R. Coe

*Attorney, Agent, or Firm*—Pierre Lesperance

[57] ABSTRACT

A dishwashing machine having a box-like closed main frame with a front vertical opening and a door for closing the front opening. A hinge pivotally interconnects the bottom edge section of the door to the bottom front edge section of the main frame. A latch releasably lockingly anchors the top edge section of the door to the top front edge section of the main frame. The machine is characterized by the way the door joins with the main frame of the dishwasher when the door is closed: the side and top edge sections of the door inner face have two spaced outturned projections forming a continuous U-shape cavity, and the front and side edge sections of the top and side walls of the dishwasher main frame define an inturned U-shape cavity. The U-shape cavities engage each other when the door is closed, to prevent water escape but to allow air circulation through the joint.

2 Claims, 2 Drawing Sheets

GASKETLESS DOOR FOR DOMESTIC DISHWASHERS

CROSS-REFERENCE

This is a continuation-in-part of co-pending patent application Ser. No. 07/369,243 filed, Jun. 21, 1989, and now abandoned.

FIELD OF THE INVENTION

This invention relates to the doors of dishwashing machines, and more particularly to the means for sealing the same against liquid escape.

BACKGROUND OF THE INVENTION

In industrialized countries such as Canada, U.S.A., and the West European countries, the dishwashing machine is considered almost a "necessity", and a large majority of the families of these countries have one such machine. Such a machine automatically washes, rinses and dries dishes, knives and forks, glasses, and the like according to a timer-controlled washing/rinsing/drying cycle.

Conventionally, the door, when closed, is completely sealed to the dishwasher main frame to prevent the washing liquid from undesirably escaping and wet and stain the proximate surroundings during said washing and rinsing cycles. Gaskets are used for that purpose. However, wear thereof develops with time, and the door comes to eventually leak. Also, the air pressure inside the washing compartment constantly increases and decreases during water filling and emptying, resulting in noisy and energy wasting operation of the water filling and emptying pump since this pump also works to vary the air pressure within the compartment.

OBJECTS OF THE INVENTION

The main object of the invention is to address the above-mentioned drawbacks.

A corollary object of the invention is to provide such a dishwashing machine, which will require few modifications of existing machines and which will be of low construction cost.

SUMMARY OF THE INVENTION

In accordance with the teachings of the invention, there is disclosed a dishwashsing machine defining a washing compartment bounded by a top wall, a bottom wall, two side walls and a rear wall, the top, bottom and side walls each defining a front edge section bounding a front quadrangular, vertical opening, a quadrangular door for closing said front opening, a hinge member pivotally interconnecting the bottom edge section of said door to said bottom wall front edge section, a latch member releasably lockingly anchoring the top edge section of said door to said top wall front edge section, water spray means for spraying water inside said washing compartment against said walls in a downwardly outwardly inclined fashion, said bottom wall having drain means for evacuation of water, and male/female labyrinth seal joint means for positively preventing sprayed liquid water produced by said spray means from escaping from said compartment through the periphery of said door once said door is closed, while allowing free air and water vapour circulation between said compartment and ambient air and vice-versa; said seal means defining a pair of outer and inner spaced parallel ridges, transversely projecting from said door interiorly about the peripheral edge section of the two side edge sections and the top edge section thereof exclusively of the bottom edge section thereof, and spacedly from the corresponding edges thereof, and a generally U-shape groove or channel, made thicknesswisely of said front edge sections of said dishwasher two side walls and top wall and spaced from the corresponding edges thereof; wherein when said door is closed and locked by said latch member, said outer ridge engages into said channel without contacting said dishwasher side walls or top wall while said inner ridge extends freely into said washing compartment proximate the inner face of the corresponding diswasher side wall or top wall; wherein a tortuous labyrinth seal passage following the contour of said ridges is defined, said passage having a thickness of about 1/32th of an inch so as to allow water vapour and air to circulate therethrough while positively preventing passage of the liquid water being sprayed by said spray means.

DETAILED DESCRIPTION OF THE INVENTION

Figure 2:
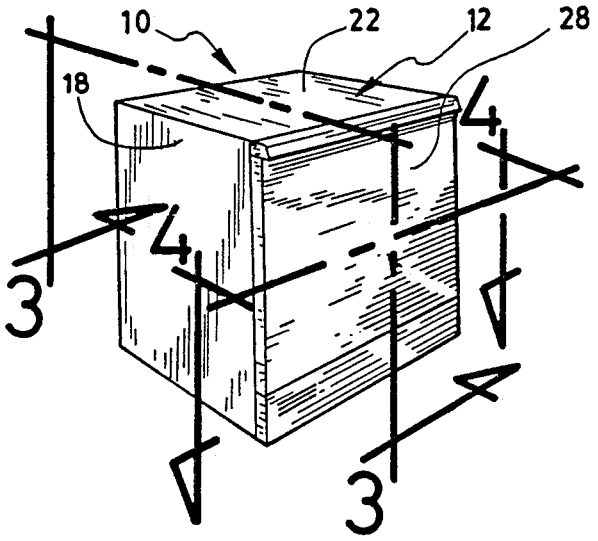
FIG. 2 is a perspective view, at a reduced scale, of the dishwasher of the invention with the door closed.
Figure 1:
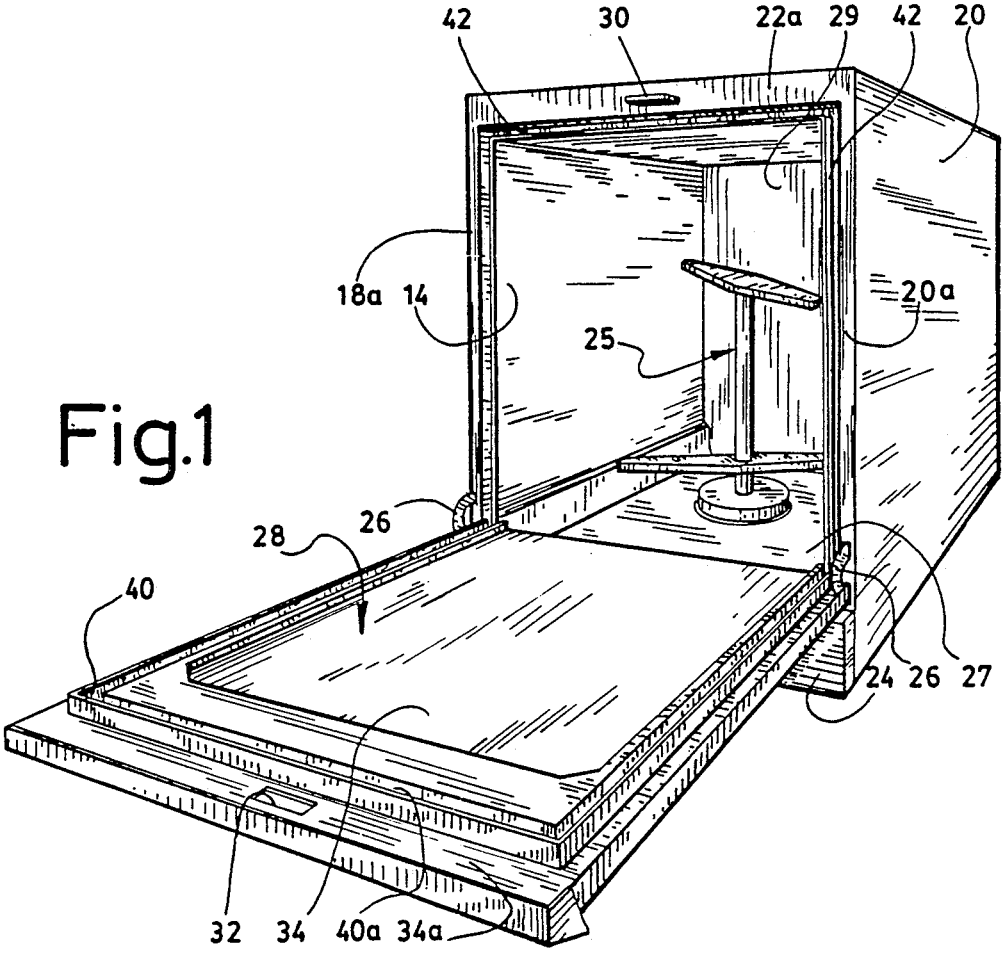
FIG. 1 is an isometric view of a dishwasher with its door open and showing a preferred embodiment of the invention.

Dishwasher 10 includes a large rigid cubic body 12 having a front door vertical opening 14 for loading/retrieving plates, glasses, forks, and the like in the dishwasher's open baskets or trays. Body 12 defines two side walls 18, 20, a rear wall 29, a top wall 22, a bottom wall 27, and a small lower front wall 24 joining the front edge **22*a* of bottom wall 27 to the bottom edge of door opening 14. Arcuate hinges 26 are mounted within the front portion 18*a* of each side wall 18 for pivoting a large door 28 about a horizontal axis between a vertical closed position, closing said door opening 14**, and a horizontal open position.

In accordance with the teachings of the invention, the inner face 34 of the dishwasher door 28 defines two spaced outturned projecting ridges 36, 38, extending edgewisely of the top and side edge portions of the door parallel to each other and spacedly from the door peripheral edge. These projections 36, 38 therefore define therebetween a continuous U-shape channel 40, at a distance from the top and side edges of the door.

The front edge sections **22*a*, 18*a*, 20*a*, of the top and side walls 22, 18, 20 of the dishwasher 10 each further includes, directly adjacent the inner edges of walls 22, 18, 20, and inturned U-shape cavity 42. These latter cavities 42 open into each other to form a continuous U-shaped channel. Thus, when the door 28 is closed, the door groove or channel 40 engages into the cavity 42 of the front edge sections spacedly therefrom; and more particularly, the outer projecting leg 36 of the door inner wall 34 engages into the trough of the latter cavity 42**.

It is noted that, once door 28 is closed, legs 36 are spaced from all the surfaces of cavities 42 and thus air and water vapour can freely circulate therethrough.

The latch member (not shown) that locks the door 28 to the dishwasher 12 may be of the type shown in my co-pending application entitled AUTOMATIC DOOR OPENING SYSTEM FOR DOMESTIC DISHWASHER, Ser. No. 07/369,242, filed Jun. 21, 1989, and now U.S. Pat. No. 4,9951,693. However, the latch member may alternately be manually operated to latch onto a loop member 30, projecting outwardly from the central portion of the front edge section 22*a* of the dishwasher top wall 22, and engaging within a hollow portion 32 made intermediate a thin edge section 34*a* of the door 28 projecting spacedly outwardly from the top channel section 40*a*.

Figure 4:
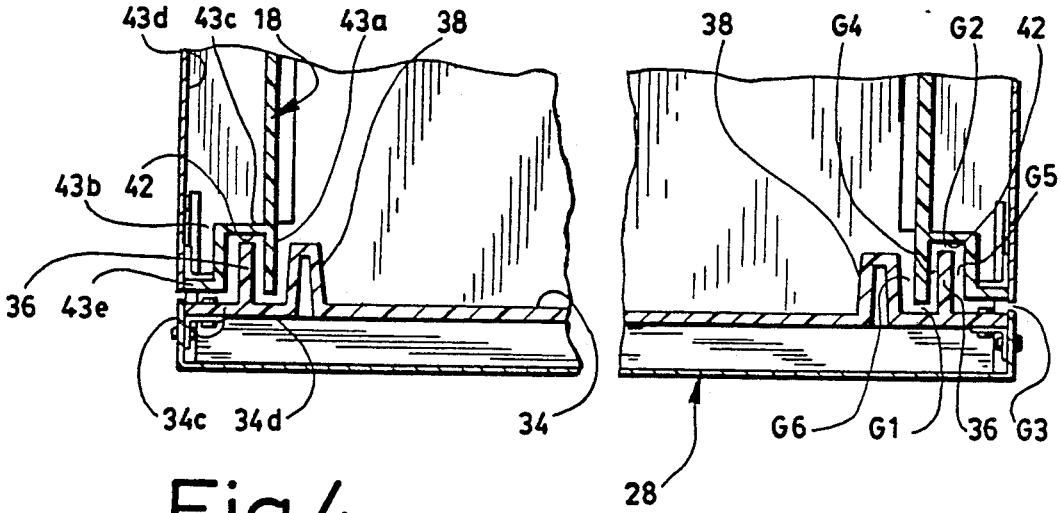
FIGS. 3 and 4 are partly broken, sectional views taken along lines 3—3 and 4—4 of FIG. 2.

As illustrated in FIG. 4, the inner projection 38 on the inner wall 34 of the door 28 may be cross-sectionally inversely V-shape, i.e. wider than cavity 42, to prevent full engagement of leg 38 into cavity 42 (rather than leg 36) when the door 38 is closed, should the door be slightly disaligned on its hinges 26.

Figure 3:
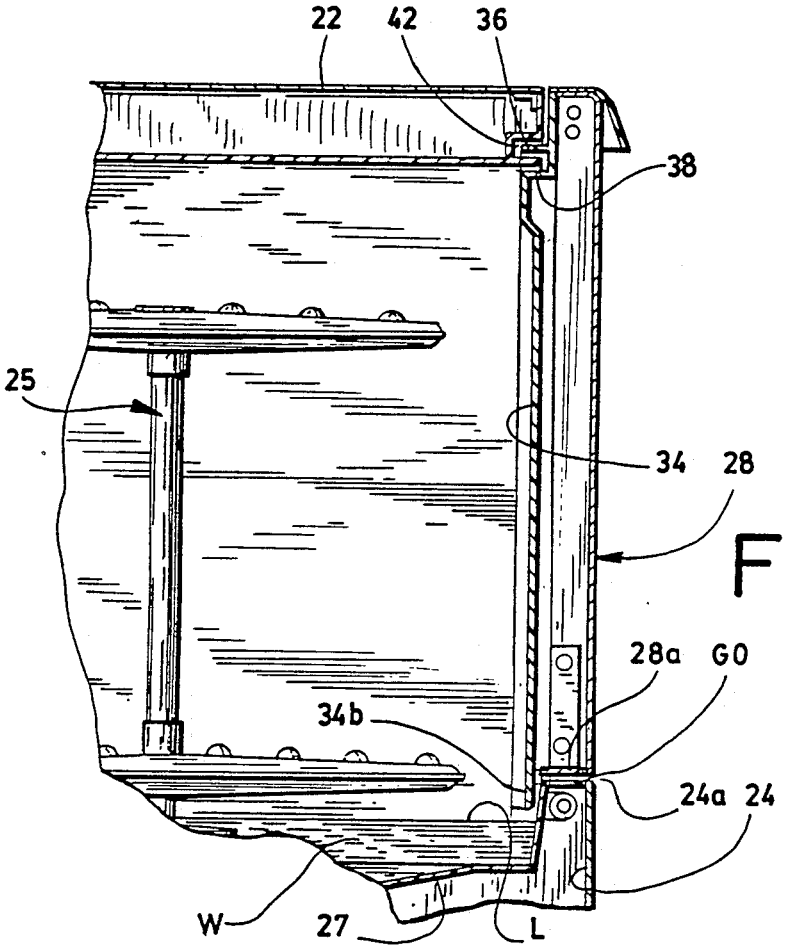

While the door 28 is fully closed, the bottom end section 34*b* of inner wall 34 of door 28 extends below the level of the top edge 24*a* of lower front wall 24 (see FIG. 3); while the bottom edge 28*a* of door 28 is spaced from the top edge wall 24*b* of panel 24; wherein a cross-sectionally L-shape gap GO is defined therebetween, whereby the dishwaser inner compartment communicates freely with the outside ambient air.

The heart of the invention lies in the non-contacting, labyrinth door seal joint shown in FIG. 4. This joint is constituted by the two parallel ridges 36, 38 projecting inwardly transversely of the door 28 on the peripheral edge section of the inner wall 34 thereof, at the two side edge sections and the top edge sections thereof, but not the bottom edge section thereof 24*a* (FIG. 3), which is simply a horizontal channel shielded from the downwardly directed water sprays from sprayer 25, by wall portion 34*b*. The cross-sectionally U-shape channel 42 is made thicknesswisely of the registering side wall 18 of the dishwasher, leg 36 engaging through channel 42. Ridges 36, 38 are spaced from each other, by door wall section 34*d*, and from the corresponding side edge of the door 28, by an inner wall edge portion 34*c*. U-shpe channel 42 thus defines two side walls 43*a*, 43*b*, a base wall 43*c*, while exterior channel leg 43*b* is spaced from the exterior face 43*d* of the dishwasher side wall 18 by a wall 43*e* orthogonal to let 43*b* and wall 43*d* and merging therewith.

Hence, when the door 28 is closed against the front edge of the side walls 43:

(a) the free end of leg 43*a* comes orthogonal to and proximate door wall portion 34*d*, spacedly by a gap G1;

(b) the free end of door leg 36 comes orthogonal to and proximate channel base wall 43*c*, spacedly by a gap G2;

(c) wall portion 34*c*, 43*e* become parallel spacedly by a gap G3;

(d) wall portions 43*a*, 43*b* become parallel spacedly to projection 36 spacedly by gaps G4 and G5; and (e) wall portion 43*a*, 38 become substantially parallel to each othr spacedly by gap G6.

The gist of the invention is that, by limiting the value of the thickness of each of the gaps G1–G6 to a narrow range of about 1/32th of an inch, while gap G0 is much larger, say about half an inch. Water sprayed onto the door 34 by the dishwasher sprayer 25 (FIG. 3) will be positively prevented from escaping through this labyrinth G1–G6 whereas water vapour and ambient air will freely circulate therethrough. Indeed, it has been found by the inventor that such dimensions of gaps G1–G6 are critical to the success of the door seal. Such thickness of 1/32th of an inch may vary very slightly in accordance with the specific density or viscosity of the water/soap solution present inside the dishwasher compartment. Hence, surface tension of this solution will prevent under the known capillarity effect the water solution in liquid state, being sprayed onto the wall by sprayer 25, from circulating through the gaps G1–G6 towards the exterior.

It is to be understood that such labyrinth seal G1–G6 is not designed to and will not prevent water from the dishwasher from escaping outwardly therefrom, if a hydrostatic pressure is applied e.g. through a column of water supported by the dishwasher bottom wall 27 and raising above the lower portions of the seal joint. (In fact, lowermost edge channel G0 will leak before the seal joint G1–G6 will leak). In any event, it should be recalled that, with known designs of dishwashers, the highest level L of water W in the dishwasher compartment will never raise up to the level of the lower edge of the door, thus will never reach the labyrinth seal G1–G6, as is suggested in FIG. 3.

Other advantages of such a dishwaser seal door in which air and water vapour circulates through the door exclusively of liquid water from the central sprayer:

(a) increased performance of the dishwasher; indeed, a water pump of reduced output could then be used, since air flow through the door edges is permitted so as to enable reestablishing pressure equilibrium pursuant to inflow/outflow of water therein. In other words, partial vacuum inside the dishwasher is prevented.

(b) the noise generated by the pump will also be lowered, since it will "breath" more easily, through the lower slit G0.

I claim:

1. A dishwashing machine defining a washing compartment bounded by a top wall, a bottom wall, two side walls and a rear wall, the top, bottom and side walls each defining a front edge section bounding a front quadrangular, vertical opening, a quadrangular door for closing said front opening, a hinge member pivotally interconnecting the bottom edge section of said door to said bottom wall front edge section, a latch member releasably lockingly anchoring the top edge section of said door to said top wall front edge section, water spray means for spraying water inside said washing compartment against said walls in a downwardly outwardly inclined fashion, said bottom wall having drain means for evacuation of water, and male/female labyrinth seal joint means for positively preventing sprayed liquid water produced by said spray means from escaping from said compartment through the periphery of said door once said door is closed, while allowing free air and water vapour circulation between said compartment and ambient air and vice-versa;

wherein said seal means defines a pair of outer and inner spaced parallel ridges, transversely projecting from said door interiorly about the peripheral edge section of the two side edge sections and the top edge section thereof exclusively of the bottom edge section thereof, and spacedly from the corresponding edges thereof, and a generally U-shape groove or channel, made thicknesswisely of said front edge sections of said dishwasher two side walls and top wall and spaced from the corresponding edges thereof; wherein when said door is closed and locked by said latch member, said outer ridge engages into said channel without contacting said dishwasher side walls or top wall while said inner ridge extends freely into said washing compartment proximate the inner face of the corresponding dishwasher side wall or top wall; wherein a tortuous labyrinth seal passage following the contour of said ridges is defined, said passage having a thickness of about 1/32th of an inch so as to allow water vapour and air to circulate therethrough while positively preventing passage of the liquid water being sprayed by said spray means.

2. A diswasher as defined in claim 1, wherein said bottom wall front edge section includes a raised extension having a flat top wall and outer and inner walls, a flow-through first gap being defined between the closed door bottom edge and said raised extension top wall, wherein said dishwasher compartment freely communicates with outside ambient air, and said door further having a flap member extending downwardly beyond the bottom end of said door and beyond said first gap, spacedly from said raised extension inner wall and substantially parallel thereto, and defining a free bottom end spaced from the dishwasher bottom wall, a second gap thereby defined being orthogonal to and communicating with said first gap, said first and second gaps being much thicker than said door seal means tortuous passage, said flap shielding said first and second gaps to prevent egress of water sprayed by said spray means, against said door; said gap means enabling the dishwasher to breathe more easily during washing/rinsing cycle thereof.

* * * * *